US009076314B2

(12) United States Patent
Miller

(10) Patent No.: US 9,076,314 B2
(45) **Date of Patent: *Jul. 7, 2015**

(54) EMERGENT INFORMATION PATTERN DRIVEN SENSOR NETWORKS

(75) Inventor: Landon C. G. Miller, Tuscaloosa, AL (US)

(73) Assignee: International Business Machines Corporation, Armonk, NY (US)

( * ) Notice: Subject to any disclaimer, the term of this patent is extended or adjusted under 35 U.S.C. 154(b) by 876 days.

This patent is subject to a terminal disclaimer.

(21) Appl. No.: 11/837,921

(22) Filed: Aug. 13, 2007

(65) Prior Publication Data

US 2009/0045946 A1 Feb. 19, 2009

(51) Int. Cl.
*G08B 23/00* (2006.01)
*G08B 25/00* (2006.01)

(52) U.S. Cl.
CPC ..... *G08B 25/009* (2013.01)

(58) Field of Classification Search
CPC ..... G08B 25/009
USPC ..... 340/517–525, 539.22–539.29, 340/853.1–856.4, 531
See application file for complete search history.

(56) References Cited

U.S. PATENT DOCUMENTS 3,988,725 A 10/1976 Doherty
4,365,238 A 12/1982 Kollin
4,622,540 A 11/1986 Guscott et al.
5,161,203 A 11/1992 Buckley
5,432,515 A * 7/1995 O'Conner ..... 342/23
5,495,237 A * 2/1996 Yuasa et al. ..... 340/854.6
5,566,092 A 10/1996 Wang et al.
5,809,499 A 9/1998 Wong et al.
5,896,082 A * 4/1999 MacFarlane ..... 340/286.05
5,940,529 A 8/1999 Buckley
6,249,241 B1 6/2001 Jordan et al.
6,257,354 B1 7/2001 Schrader et al.
6,437,692 B1 8/2002 Petite et al.
6,515,586 B1 2/2003 Wymore
6,735,630 B1 5/2004 Gelvin et al.
6,930,596 B2 8/2005 Kulesz et al.
6,987,459 B2 1/2006 Tice
7,025,130 B2 * 4/2006 Bailey et al. ..... 166/65.1
7,053,770 B2 5/2006 Ratiu et al.
7,148,803 B2 12/2006 Bandy et al.
7,271,704 B2 9/2007 McSheffrey et al.
7,475,428 B2 1/2009 Smith et al.
7,496,472 B2 2/2009 Seem
7,528,711 B2 5/2009 Kates (Continued)

OTHER PUBLICATIONS

U.S. Appl. No. 11/837,955—Non-final Office Action dated Aug. 17, 2009.

(Continued)

*Primary Examiner* — Thomas Mullen
(74) *Attorney, Agent, or Firm* — Yudell Isidore PLLC; John Pivnichny

(57) ABSTRACT

Emergent information is created and utilized by an array of sensors. Each sensor is programmed with a trigger rule, which describes a local condition that must be met for the sensor to trigger an event signal, and a relationship rule, which describes a hierarchy of communication control among sensors in the array of sensors. When a predetermined percentage or weighting of the sensors trigger event signals, emergent information that describes conditions at the array location is generated.

20 Claims, 9 Drawing Sheets

(56) References Cited

U.S. PATENT DOCUMENTS

| | | | | |
|---|---|---|---|---|
| 7,693,589 | B2 | 4/2010 | Miller | |
| 7,710,257 | B2 | 5/2010 | Miller | |
| 7,710,258 | B2 | 5/2010 | Miller | |
| 7,710,259 | B2 | 5/2010 | Miller | |
| 7,710,260 | B2 | 5/2010 | Miller | |
| 2003/0171939 | A1 | 9/2003 | Yagesh et al. | |
| 2005/0124291 | A1 | 6/2005 | Hart et al. | |
| 2005/0271266 | A1* | 12/2005 | Perrier | 382/157 |
| 2005/0275530 | A1* | 12/2005 | Kates | 340/539.22 |
| 2006/0176169 | A1* | 8/2006 | Doolin et al. | 340/521 |
| 2007/0015548 | A1 | 1/2007 | Flick | |
| 2007/0061022 | A1 | 3/2007 | Hoffberg-Borghesani et al. | |
| 2007/0096899 | A1 | 5/2007 | Johnson | |
| 2007/0097993 | A1 | 5/2007 | Bojahra et al. | |
| 2007/0132846 | A1 | 6/2007 | Broad et al. | |
| 2007/0167859 | A1 | 7/2007 | Finnerman | |
| 2007/0250461 | A1 | 10/2007 | Sabe et al. | |
| 2008/0094212 | A1 | 4/2008 | Breed | |
| 2008/0109091 | A1* | 5/2008 | Joslin et al. | 700/32 |
| 2009/0022548 | A1* | 1/2009 | Bishop | 405/33 |

OTHER PUBLICATIONS

U.S. Appl. No. 11/838,729—Notice of Allowance dated Nov. 17, 2009.
U.S. Appl. No. 11/838,684—Notice of Allowance dated Dec. 21, 2009.
U.S. Appl. No. 11/837,921, Non-Final Office Action dated Dec. 29, 2009.
U.S. Appl. No. 11/838,618, Non-Final Office Action dated Jun. 22, 2009.
U.S. Appl. No. 11/838,656, Non-Final Office Action dated Jun. 22, 2009.
U.S. Appl. No. 11/838,739, Non-Final Office Action dated May 15, 2009.
U.S. Appl. No. 11/838,729, Non-Final Office Action dated May 11, 2009.
U.S. Appl. No. 11/838,684, Non-Final Office Action dated Jun. 22, 2009.
U.S. Appl. No. 11/838,695, Non-Final Office Action dated Jun. 22, 2009.
U.S. Appl. No. 11/838,739, Final Office Action dated Nov. 13, 2009.
U.S. Appl. No. 11/838,637, Non-Final Office Action dated Jan. 20, 2010.
U.S. Appl. No. 11/837,955, Final Office Action dated Mar. 5, 2010.
U.S. Appl. No. 11/838,739, Notice of Allowance dated Feb. 26, 2010.
U.S. Appl. No. 11/838,618, Notice of Allowance dated Dec. 17, 2009.
U.S. Appl. No. 11/838,656, Notice of Allowance dated Dec. 17, 2009.
U.S. Appl. No. 11/838,695, Notice of Allowance dated Dec. 17, 2009.
U.S. Appl. No. 11/837,886, Non-Final Office Action dated May 27, 2010.
U.S. Appl. No. 11/838,637, Final Office Action dated Jun. 16, 2010.
U.S. Appl. No. 11/838,769, Notice of Allowance dated Jun. 15, 2010.

* cited by examiner

EMERGENT INFORMATION PATTERN DRIVEN SENSOR NETWORKS

The present invention is related to the subject matter of the following commonly assigned, copending United States patent applications: (1) Ser. No. 11/837,886 (now U.S. Pat. No. 7,979,088) titled "Water Friend or Foe System for Global Vessel Identification and Tracking", filed Aug. 13, 2007; (2) Ser. No. 11/837,955 (now U.S. Pat. No. 8,712,987) titled "Emergent Information Database Management System", filed Aug. 13, 2007; (3) Ser. No. 11/838,684 (now U.S. Pat. No. 7,710,257) entitled "Pattern Driven Effectuator System", filed Aug. 14, 2007; (4) Ser. No. 11/838,729 (now U.S. Pat. No. 7,693,589) titled "Anomaly Anti-Pattern", filed Aug. 14, 2007; and (5) Ser. No. 11/838,764 (now U.S. Pat. No. 7,992,094) titled "Intelligence Driven Icons and Cursors", filed Aug. 14, 2007. The content of the above-referenced applications is incorporated herein by reference.

BACKGROUND OF THE INVENTION

1. Technical Field

The present disclosure relates to the field of sensor networks and the alerts they develop when sensing emergent information that they are cued to look for.

2. Description of the Related Art

Currently, system sensors collect data in a non-intelligent manner. That is, even if a sensor has limited intelligence (e.g., a camera that automatically tracks moving objects), most of the data collected by the sensors, and then transmitted to a controller, is meaningless. That is, sensors typically transmit data in a continuous manner, such that most of the transmitted data is "dead air" in which nothing of interest is happening. Even if some intelligence is present in the sensor, the data transmitted concerns what that particular sensor type is able to detect, and thus has little selectivity associated with such transmitted data. Thus, most sensors systems are either burdened with high positive and negative error rates, or send "dead air," or both. To find a subject matter of interest, the controller must perform extensive data mining, using programs that search for patterns of interest in the massive amounts of previously stored data. Most searching is for simple, single sensor type, threshold events.

SUMMARY OF THE INVENTION

Emergent information is first created. Patterns of such data, which comprise the emergent information, are then downloaded into and utilized by an array of sensors. Each sensor is programmed with a trigger rule, which describes a local condition that must be met for the sensor to trigger an event signal, and a relationship rule, which describes a hierarchy of communication control among sensors in the array of sensors. When a predetermined percentage (or weighting of importance) of the sensors trigger event signals, notices (or alerts) indicate that such emergent information, which describes the pre-established conditions at the array location, has been generated.

The above, as well as additional purposes, features, and advantages of the present invention will become apparent in the following detailed written description.

BRIEF DESCRIPTION OF THE DRAWINGS

The novel features believed characteristic of the invention are set forth in the appended claims. The invention itself, however, as well as a preferred mode of use, further purposes and advantages thereof, will best be understood by reference to the following detailed description of an illustrative embodiment when read in conjunction with the accompanying drawings, where:

DETAILED DESCRIPTION OF THE PREFERRED EMBODIMENT

Figure 1:
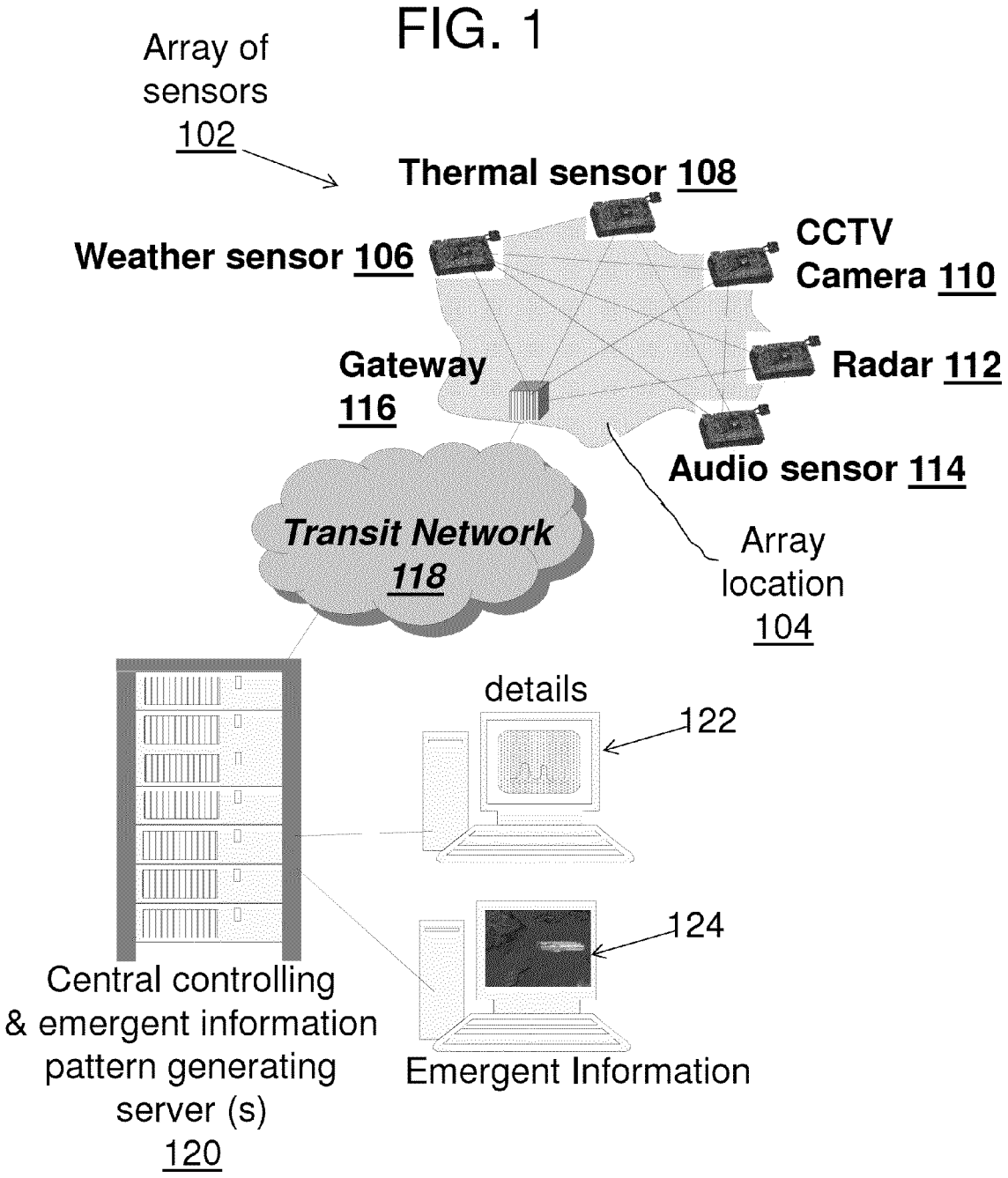
FIG. 1 depicts an exemplary array of sensors used to generate emergent information about a sensor field (sensor location)

Presently presented is a hardware, software and process system for using emergent information patterns to drive a sensor network. As described in detail below, a field of smart sensors is interactive. A controlling software, which describes a set of data representing search patterns for the field of sensors, is pre-programmed or downloaded to the field of sensors. Each sensor "votes" as to whether it has detected an external stimulus that fits in any of the search patterns stored within the sensor. As the "vote" tally reaches a high enough percentage of "opt-in's," against a time line per pattern, individual sensors within the sensor field take turns trying to get the results of the vote and its supporting details, already constantly shared amongst the sensors using a communications protocol, such as Zigbee™, which supports these voting and alternate sending techniques out via various telecommunications channels. Once one sensor gets the message out, the process re-commences.

Multiple information patterns can be searched for at once, since the information patterns are all pre-downloaded, and all can be checked against all the time. These information patterns can be updated and changed, and new information patterns can be added by a local or remote controller.

Reports generated by the output of data from the field of sensors provide pattern details (describing the pattern of sensed data), supporting data (that supports the pattern details), emergent results (next-level information that becomes "apparent" only after the data is received from the field of sensors), and other deterministic realtime information (including diagnostic data regarding the health of each sensor and its lines of communication with other sensors and the controller).

The novel system described herein is extremely valuable when attempting to deal with deterministic realtime problems, including those resulting from circumstances that are more complex than those created by just a single sensor being set off. Furthermore, the process and system described here are valuable to any situation where more than one sensor or type of sensor is needed to develop emergent information, or that information needed for a human to recognize a pattern that serves a useful purpose.

This new system also creates a low power consumption profile for each sensor, since each sensor does not have to report no operation ("no op") all the time (i.e., the present invention does not require each sensor to continuously report insignificant non-events). As described herein, each sensor in the field can take turns reporting that emergent information has been detected for the whole field of sensors. This provides many network paths to get a report out when needed, since each individual sensor can be connected separately (e.g., through a Zigbee™-type network) for outbound purposes, and thus one sensor can report for all. This approach also provides for deterministic realtime pattern evaluation, as well as constant addition, deletion, and changes of information patterns to be analyzed by the field of sensors. Furthermore, some of the field sensors can be out and the overall field of sensors can still be successful due to built-in redundancy. In addition, with some patterns, a tentative "yes" vote can automatically occur when a pre-determined level of "hits" by sensors (e.g., two-thirds of the sensors reporting against a pattern, or by weighting the value of individual sensor "hits") is accumulated within a time period, for example. Thus, a weighted percentage of sensor hits will cause the "yes" vote to occur (such that each sensor has a weighted value, and the weighted percentage is a product function of the sum of the tripped sensors times each sensor's weighted value).

This system works by pre-establishing emergent information and its patterns, and then downloading those patterns into smart sensors fields that now analyze each sensor's external data capture to:

1) match against those patterns in deterministic realtime mode;

2) vote as to matches using inter-networking technologies within time lines per pattern;

3) signal out when a sufficient match is established;

4) monitor for sensor health;

5) accept constant downloads of adds, deletes and changes to search patterns; and 6) work in degraded conditions such as sensors out, overloaded communications, and interference.

With reference now to FIG. 1, an exemplary array of sensors 102 in an array location 104 (sensor field) is depicted. For exemplary purposes, assume that the array location 104 is a coastline, in which there is a high traffic of maritime smuggling. The array of sensors 102 is pre-programmed with logic to detect suspicious activity. For example, the weather sensor 106 may detect inclement weather (e.g., cloud cover at night to make marine vessel detection difficult); the thermal sensor 108 may detect a thermal image of a marine vessel (e.g., how many engines it has and how many people are on board); a Closed Circuit Television (CCTV) camera 110 can intelligently detect and slave to moving objects on the water; a radar 112 system can detect the speed and movement of larger marine vessels; and an audio sensor 114 (e.g., an underwater hydrophone, an air microphone, etc.) can detect and interpret certain sound patterns for suspicious marine vessels (e.g., high-speed "cigarette" boats favored by drug traffickers). Within each sensor in the array of sensors 102 is programmed trigger rules, relationship rules, and emergent information logic.

A trigger rule is a rule that describes what conditions must be met for a sensor to issue an event signal to the other sensors in the array of sensors 102. For example, weather sensor 106 may have a trigger rule that requires weather sensor 106 to issue an event signal whenever a local rain gauge, barometer and thermometer indicate rainy conditions. Similarly, thermal sensor 108 may have a trigger rule that requires thermal sensor 108 to issue an event signal if the heat signature of only one person is registered in a cigarette boat, whose presence was detected by radar 112. The presence of the cigarette boat was put onto the array of sensors 102 in response to a trigger rule (e.g., speed and path measured by CCTV camera 110 and/or radar 112) being fired in radar 112. Likewise, if audio sensor 114 recognizes an audio signature of a suspicious marine vessel (e.g., a cigarette boat), this causes the trigger rule in the audio sensor 114 to cause the release of an event signal from the audio sensor 114.

Relationship rules are rules that define how sensors should communicate among themselves, and which sensor should communicate with a remote controller, if necessary. As shown in FIG. 1, all sensors are interlocked, such that every sensor communicates with every other sensor in the array of sensors 102. However, in another embodiment, some sensors may communicate with only certain other sensors within the array of sensors 102, or some sensors may communicate with sensors in other sensor arrays (not shown).

The relationship rules also come into play if a consolidated event signal (based on a predetermined number of sensors in the array of sensors 102 firing off event signals) is to be transmitted, via a gateway 116 and a transmit network 118 (e.g., a local IP-based or similar network), to a remote controller 120.

Emergent information logic (either software or hardware) is also part of each sensor. That is, each sensor may be able to consolidate event triggers from all sensors in the array of sensors 102, in order to generate emergent information that describes conditions about the array location 104. Thus, in the example described above, each sensor may be able determine that, based on event triggers caused by stormy weather (signaled by weather sensor 106), an audio signature of a cigarette boat (from audio sensor 114), and fast movement of the cigarette boat from a known drug-offloading location (from radar 112), a drug smuggling operation is likely in effect. Response to this may be local (e.g., turning on floodlights (not shown) in the array location 104) or remote (e.g., notifying a local law enforcement agency of the event).

As noted above, in a preferred embodiment, generation of emergent information is performed by the sensors themselves, thus being faster and less prone to communication failures. However, in an alternate embodiment, event signals (responsive to trigger rules being met) may be sent to a central controlling and emergent information pattern generating server 120. This server 120 can display details of the event signals on a display 122, or a consolidation of the event signals can be displayed as emergent information on a display 124.

Figure 2:
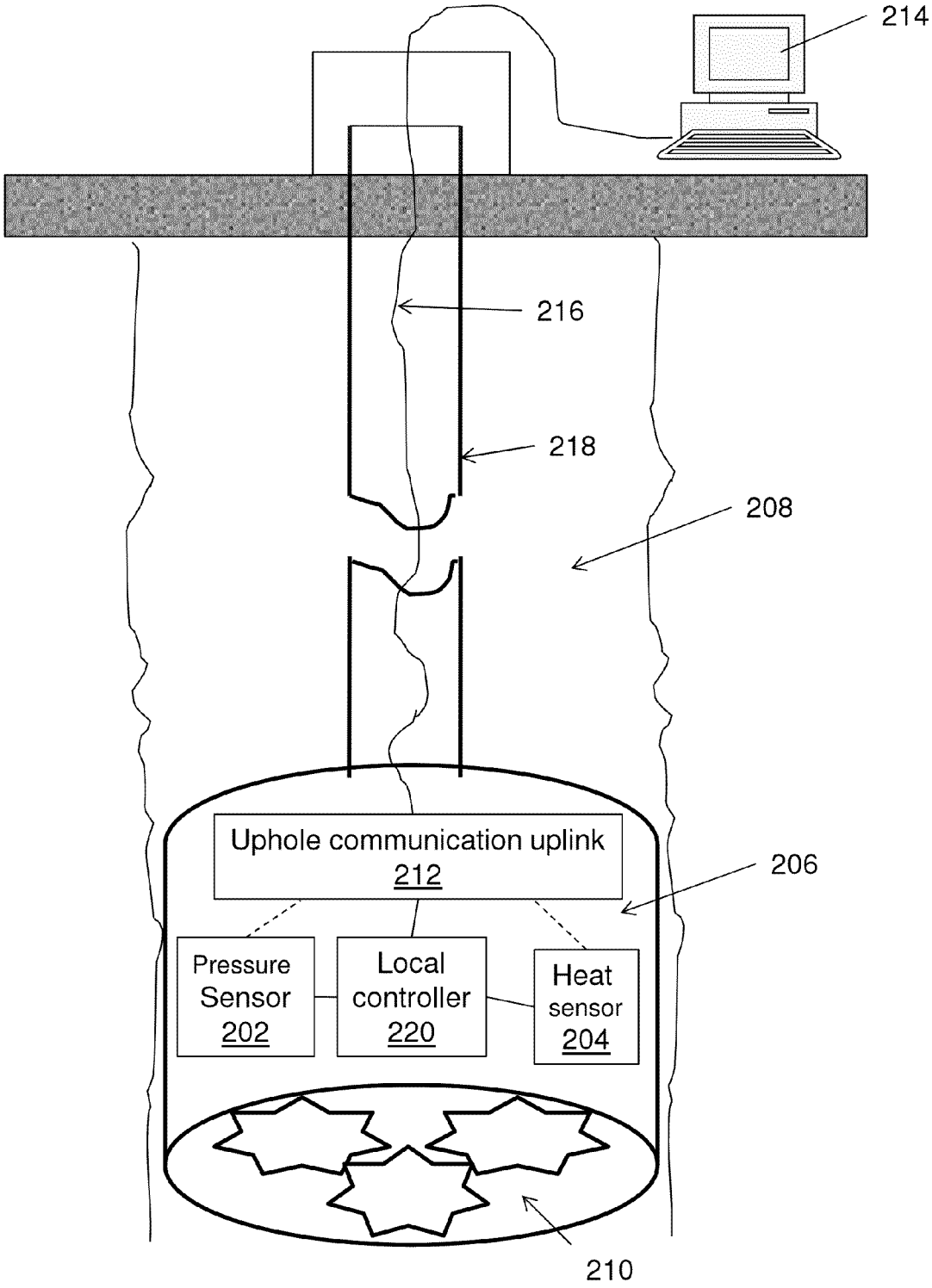
FIG. 2 illustrates a downhole implementation of the array of sensors.

Referring now to FIG. 2, another exemplary use of the present invention is presented. Assume now that the array of sensors comprises a pressure sensor 202 and a heat sensor 204 found in a downhole drill bit 206 that is drilling a well 208 (not to scale). As teeth 210 cut through different soils and rock, they can be damaged. For example, assume that teeth 210 are initially cutting through sand, but then hit hard rock. To prevent damage to teeth 210, drill bit 206 needs to immediately slow down, if not back away from the rock. If this pressure and heat information from pressure sensor 202 and heat sensor 204 were sent, via an uphole communication uplink to a computer 214, the time required to traverse the communication cable 216 inside the drill string 218 may be too long to avoid damage to the drill bit 206. Therefore, a local controller 220 causes the drill bit 206 to immediately alter operations (assuming that drill bit utilizes a locally controlled motor—not shown), thus preventing damage to the teeth 210 and the rest of the drill bit and motor. In a preferred embodiment, local controller 220 is not a different component, but is actually a compilation of rule and event logic (such as that describe above in FIG. 1) that is part of pressure sensor 202 and heat sensor 204.

Note that in one embodiment, computer 214 acts as a remote controller that is capable of updating the trigger rules and communication rules found in the sensors. That is, although pressure sensor 202 and heat sensor 204 comprise their own trigger rules (for triggering event signals) and relationship rules (for intra and extra-communication) to create the emergent information needed to stop the drilling operation, these rules may be downloaded and/or upgraded by computer 214.

Figure 3A:
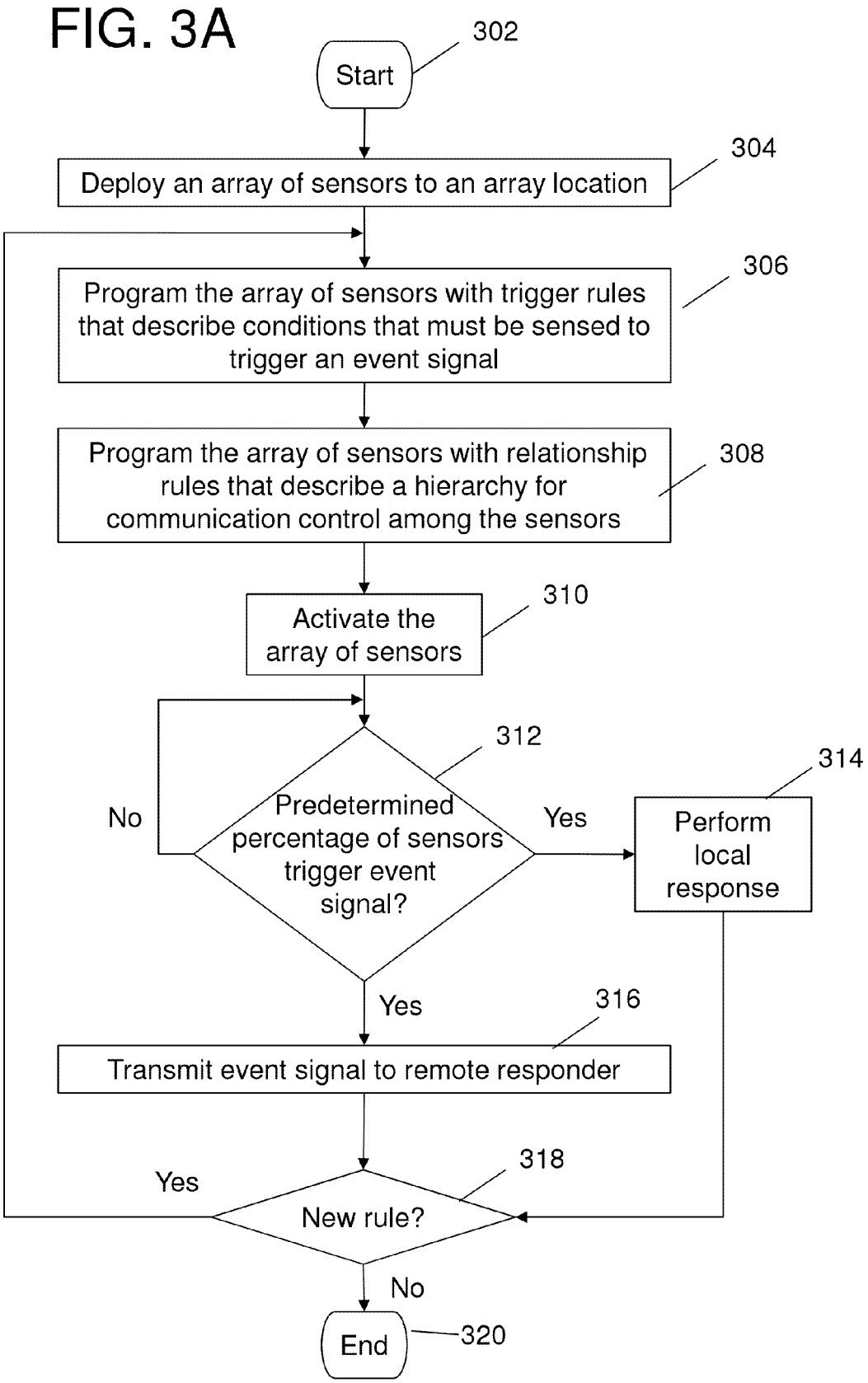
FIG. 3A is a flow-chart of exemplary steps taken to utilize emergent information that is created by an array of sensors.

With reference now to FIG. 3A, a flow-chart of exemplary steps taken to utilize emergent information from a sensor field is presented. After initiator block 302, which may be prompted by a project to monitor field conditions, an array of sensors is deployed to an array location in the field (block 304). These sensors are programmed (either before or after deployment) with trigger rules (block 306) and relationship rules (block 308), which are described above. These rules may be pre-programmed before the sensors are deployed to the field, or they may be programmed by a remote controller as described above.

After the array of sensors are activated (block 310), a query is made to determine if a predetermined percentage of the sensors have triggered an event signal (query block 312). If so, this creates emergent information that describes an overall picture of conditions at the array location. Preferably, the array of sensors use their consolidated logic to perform a local response (block 314), which addresses/corrects the perceived conditions at the array location. Note that in one embodiment, this local response is to turn a sensor on. Thus, to conserve battery life, a particular sensor may be turned on only if another sensor detects a condition in which the particular sensor is needed. In the example described above for drug interdiction (FIG. 1), the CCTV camera 110 may be on "stand by" until radar 112 detects suspicious movement, thus saving power consumption by CCTV camera 110.

Alternatively, the consolidated response (emergent information) is sent to a remote responder (e.g., local law enforcement described in FIG. 1), as described in block 316. If a determination is made that a trigger rule or a relationship rule for one or more of the sensors needs to be updated (query block 318), this action is performed by the remote controller (or alternatively, by one of the sensors). The process ends at terminator block 320.

Figure 3B:
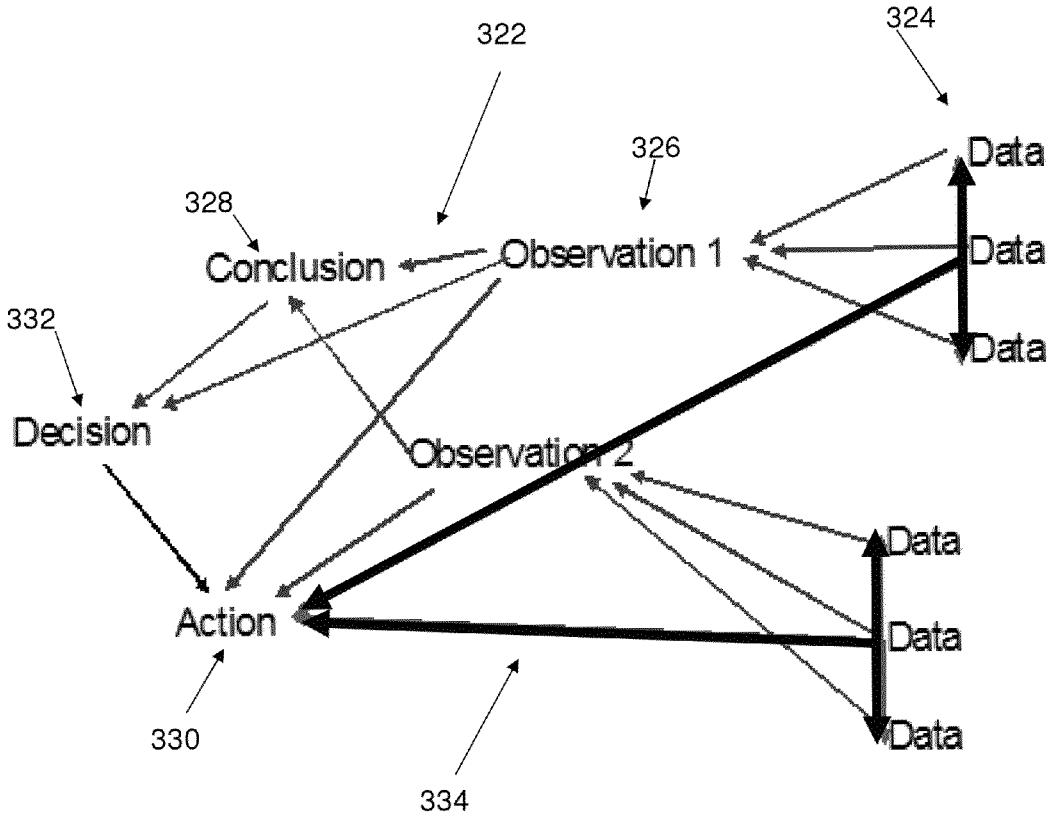
FIG. 3B depicts a difference between process patterns and data patterns.

Note that the present invention utilizes a data pattern approach, rather than a process pattern approach. That is, FIG. 3B demonstrates the process pattern approach (exemplified by thin lines 322) as the approach of collecting data 324, which leads to one or more observations 326, which leads to conclusions 328 and/or actions 330 that are controlled by a decision maker 332. The present invention bypasses most of these steps by allowing data 324, which conforms to a known pattern, to automatically lead directly to an action 330, as represented by a data pattern approach that is depicted by the thicker lines 334.

Figure 4:
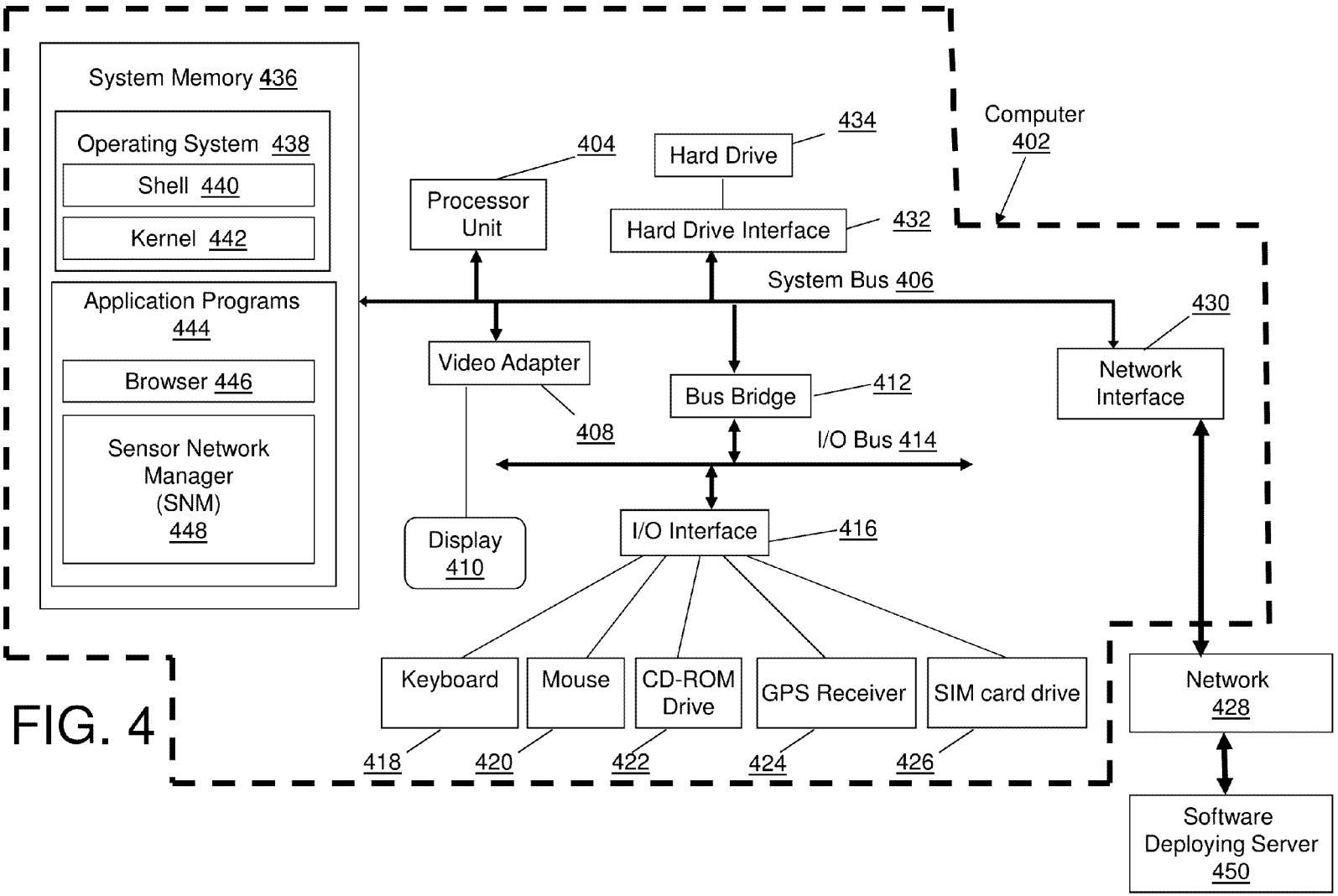
FIG. 4 illustrates an exemplary computer in which the present invention may be utilized.

With reference now to FIG. 4, there is depicted a block diagram of an exemplary computer 402, in which the present invention may be utilized. Note that some or all of the exemplary architecture shown for computer 402 may be utilized by software deploying server 450, as well as server 120 and elements 106-116 shown in FIG. 1.

Computer 402 includes a processor unit 404 that is coupled to a system bus 406. A video adapter 408, which drives/supports a display 410, is also coupled to system bus 406. System bus 406 is coupled via a bus bridge 412 to an Input/Output (I/O) bus 414. An I/O interface 416 is coupled to I/O bus 414. I/O interface 416 affords communication with various I/O devices, including a keyboard 418, a mouse 420, a Compact Disk-Read Only Memory (CD-ROM) drive 422, a GPS receiver 424, and a SIM card drive 426. The format of the ports connected to I/O interface 416 may be any known to those skilled in the art of computer architecture, including but not limited to Universal Serial Bus (USB) ports.

Computer 402 is able to communicate with a software deploying server 450 via a network 428 using a network interface 430, which is coupled to system bus 406. Network 428 may be an external network such as the Internet or transit network 118 shown in FIG. 1, or an internal network such as an Ethernet or a Virtual Private Network (VPN).

A hard drive interface 432 is also coupled to system bus 406. Hard drive interface 432 interfaces with a hard drive 434. In a preferred embodiment, hard drive 434 populates a system memory 436, which is also coupled to system bus 406. System memory is defined as a lowest level of volatile memory in computer 402. This volatile memory includes additional higher levels of volatile memory (not shown), including, but not limited to, cache memory, registers and buffers. Data that populates system memory 436 includes computer 402's operating system (OS) 438 and application programs 444.

OS 438 includes a shell 440, for providing transparent user access to resources such as application programs 444. Generally, shell 440 is a program that provides an interpreter and an interface between the user and the operating system. More specifically, shell 440 executes commands that are entered into a command line user interface or from a file. Thus, shell 440 (as it is called in UNIX®), also called a command processor in Windows®, is generally the highest level of the operating system software hierarchy and serves as a command interpreter. The shell provides a system prompt, interprets commands entered by keyboard, mouse, or other user input media, and sends the interpreted command(s) to the appropriate lower levels of the operating system (e.g., a kernel 442) for processing. Note that while shell 440 is a text-based, line-oriented user interface, the present invention will equally well support other user interface modes, such as graphical, voice, gestural, etc.

As depicted, OS 438 also includes kernel 442, which includes lower levels of functionality for OS 438, including providing essential services required by other parts of OS 438 and application programs 444, including memory management, process and task management, disk management, and mouse and keyboard management.

Application programs 444 include a browser 446. Browser 446 includes program modules and instructions enabling a World Wide Web (WWW) client (i.e., computer 402) to send and receive network messages to the Internet using HyperText Transfer Protocol (HTTP) messaging, thus enabling communication with software deploying server 450 and other described computer systems.

Application programs 444 in computer 402's system memory (as well as software deploying server 450's system memory) also include a Sensor Network Manager (SNM) 448. SNM 448 includes code for implementing the processes described in FIGS. 1-3A. In one embodiment, computer 402 is able to download SNM 448 from software deploying server 450.

The hardware elements depicted in computer 402 are not intended to be exhaustive, but rather are representative to highlight essential components required by the present invention. For instance, computer 402 may include alternate memory storage devices such as magnetic cassettes, Digital Versatile Disks (DVDs), Bernoulli cartridges, and the like.

These and other variations are intended to be within the spirit and scope of the present invention.

Note further that, in a preferred embodiment of the present invention, software deploying server 450 performs all of the functions associated with the present invention (including execution of SNM 448), thus freeing computer 402 from having to use its own internal computing resources to execute. SNM 448.

It should be understood that at least some aspects of the present invention may alternatively be implemented in a computer-readable medium that contains a program product. Programs defining functions of the present invention can be delivered to a data storage system or a computer system via a variety of tangible signal-bearing media, which include, without limitation, non-writable storage media (e.g., CD-ROM), writable storage media (e.g., hard disk drive, read/write CD ROM, optical media), as well as non-tangible communication media, such as computer and telephone networks including Ethernet, the Internet, wireless networks, and like network systems. It should be understood, therefore, that such signal-bearing media when carrying or encoding computer readable instructions that direct method functions in the present invention, represent alternative embodiments of the present invention. Further, it is understood that the present invention may be implemented by a system having means in the form of hardware, software, or a combination of software and hardware as described herein or their equivalent.

Software Deployment

As described above, in one embodiment, the processes described by the present invention, including the functions of SNM 448, are performed by service provider server 450. Alternatively, SNM 448 and the method described herein, and in particular as shown and described in FIGS. 1-3A, can be deployed as a process software from service provider server 450 to computer 402. Still more particularly, process software for the method so described may be deployed to service provider server 450 by another service provider server (not shown).

Figure 5A:
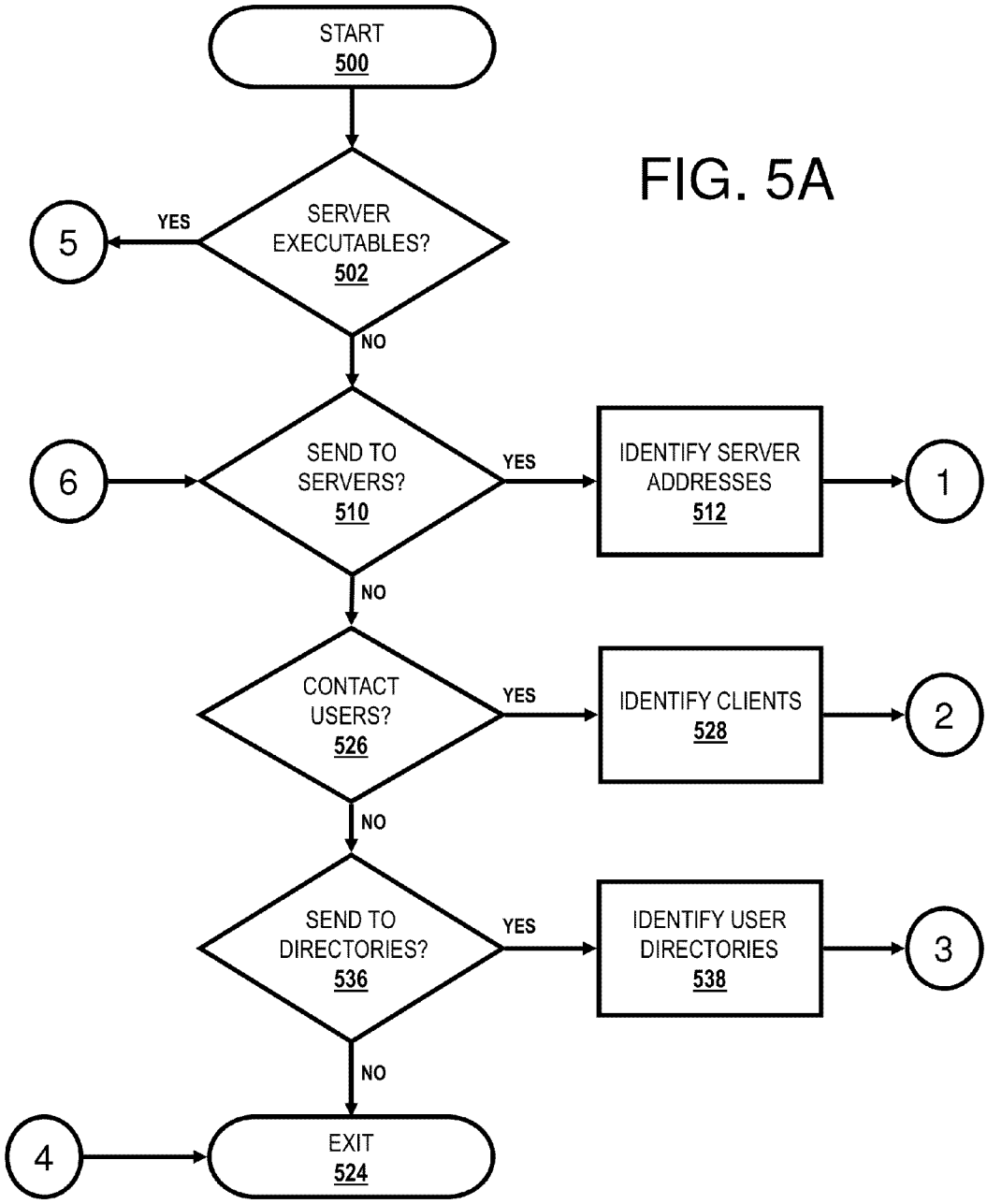
FIGS. 5A-B are flow-charts showing steps taken to deploy software capable of executing the steps described in FIGS. 1-3A.
Figure 5B:
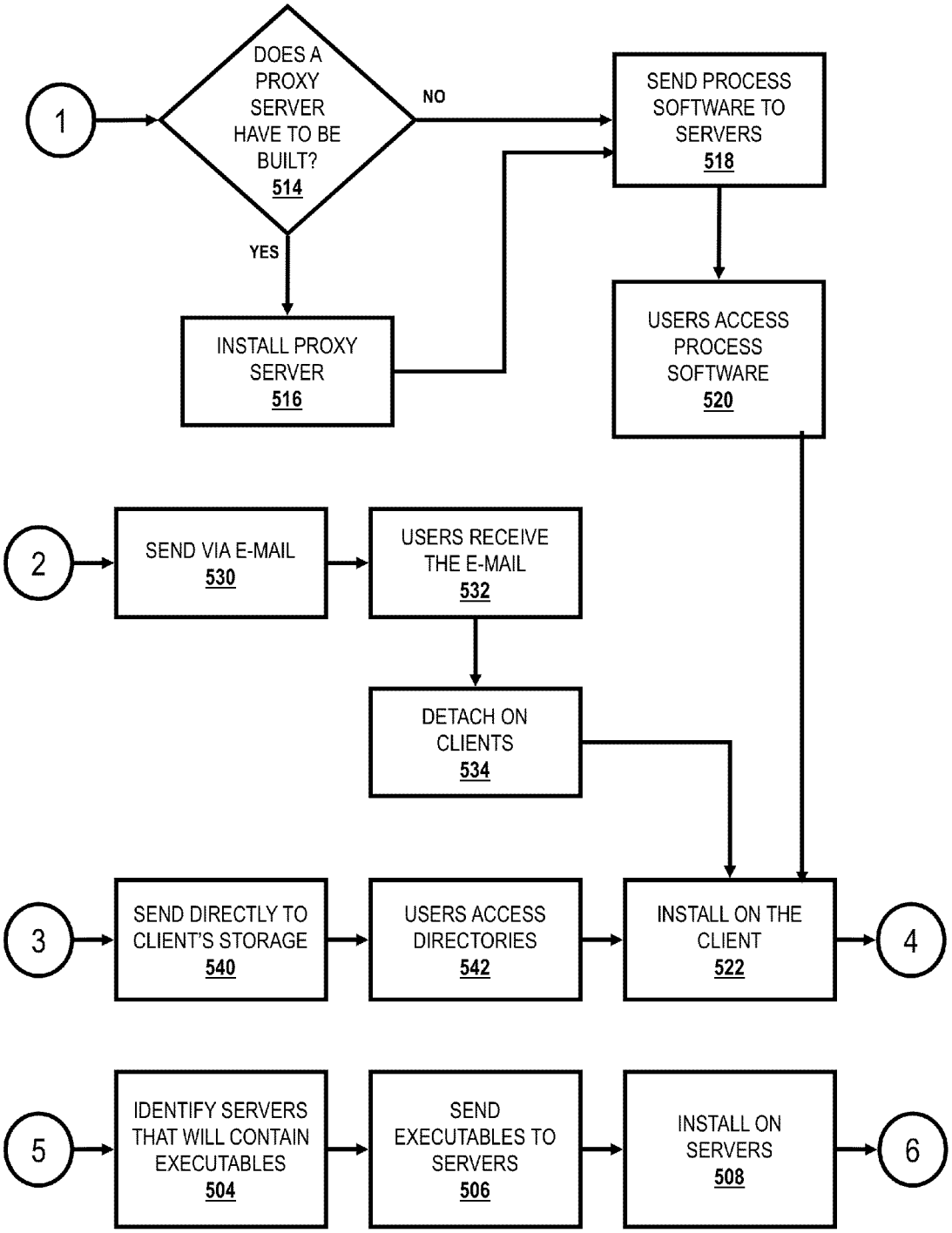

Referring then to FIGS. 5A-B, step 500 begins the deployment of the process software. The first thing is to determine if there are any programs that will reside on a server or servers when the process software is executed (query block 502). If this is the case, then the servers that will contain the executables are identified (block 504). The process software for the server or servers is transferred directly to the servers' storage via File Transfer Protocol (FTP) or some other protocol or by copying though the use of a shared file system (block 506). The process software is then installed on the servers (block 508).

Next, a determination is made on whether the process software is to be deployed by having users access the process software on a server or servers (query block 510). If the users are to access the process software on servers, then the server addresses that will store the process software are identified (block 512).

A determination is made if a proxy server is to be built (query block 514) to store the process software. A proxy server is a server that sits between a client application, such as a Web browser, and a real server. It intercepts all requests to the real server to see if it can fulfill the requests itself. If not, it forwards the request to the real server. The two primary benefits of a proxy server are to improve performance and to filter requests. If a proxy server is required, then the proxy server is installed (block 516). The process software is sent to the servers either via a protocol such as FTP or it is copied directly from the source files to the server files via file sharing (block 518). Another embodiment would be to send a transaction to the servers that contained the process software and have the server process the transaction, then receive and copy the process software to the server's file system. Once the process software is stored at the servers, the users, via their computers, then access the process software on the servers and copy to their computers file systems (block 520). Another embodiment is to have the servers automatically copy the process software to each client and then run the installation program for the process software at each computer. The user executes the program that installs the process software on his computer (block 522) then exits the process (terminator block 524).

In query step 526, a determination is made whether the process software is to be deployed by sending the process software to users via e-mail. The set of users where the process software will be deployed are identified together with the addresses of the user computers (block 528). The process software is sent via e-mail to each of the users' computers (block 530). The users then receive the e-mail (block 532) and then detach the process software from the e-mail to a directory on their computers (block 534). The user executes the program that installs the process software on his computer (block 522) then exits the process (terminator block 524).

Lastly a determination is made as to whether the process software will be sent directly to user directories on their computers (query block 536). If so, the user directories are identified (block 538). The process software is transferred directly to the user's computer directory (block 540). This can be done in several ways such as but not limited to sharing of the file system directories and then copying from the sender's file system to the recipient user's file system or alternatively using a transfer protocol such as File Transfer Protocol (FTP). The users access the directories on their client file systems in preparation for installing the process software (block 542). The user executes the program that installs the process software on his computer (block 522) and then exits the process (terminator block 524).

VPN Deployment

The present software can be deployed to third parties as part of a service wherein a third party VPN service is offered as a secure deployment vehicle or wherein a VPN is build on-demand as required for a specific deployment.

A virtual private network (VPN) is any combination of technologies that can be used to secure a connection through an otherwise unsecured or untrusted network. VPNs improve security and reduce operational costs. The VPN makes use of a public network, usually the Internet, to connect remote sites or users together. Instead of using a dedicated, real-world connection such as leased line, the VPN uses "virtual" connections routed through the Internet from the company's private network to the remote site or employee. Access to the software via a VPN can be provided as a service by specifically constructing the VPN for purposes of delivery or execution of the process software (i.e. the software resides elsewhere) wherein the lifetime of the VPN is limited to a given period of time or a given number of deployments based on an amount paid.

The process software may be deployed, accessed and executed through either a remote-access or a site-to-site VPN. When using the remote-access VPNs the process software is deployed, accessed and executed via the secure, encrypted connections between a company's private network and remote users through a third-party service provider. The enterprise service provider (ESP) sets a network access server (NAS) and provides the remote users with desktop client software for their computers. The telecommuters can then dial a toll-free number or attach directly via a cable or DSL modem to reach the NAS and use their VPN client software to access the corporate network and to access, download and execute the process software.

When using the site-to-site VPN, the process software is deployed, accessed and executed through the use of dedicated equipment and large-scale encryption that are used to connect a company's multiple fixed sites over a public network such as the Internet.

The process software is transported over the VPN via tunneling which is the process of placing an entire packet within another packet and sending it over a network. The protocol of the outer packet is understood by the network and both points, called tunnel interfaces, where the packet enters and exits the network.

Software Integration

The process software which consists of code for implementing the process described herein may be integrated into a client, server and network environment by providing for the process software to coexist with applications, operating systems and network operating systems software and then installing the process software on the clients and servers in the environment where the process software will function.

The first step is to identify any software on the clients and servers, including the network operating system where the process software will be deployed, that are required by the process software or that work in conjunction with the process software. This includes the network operating system that is software that enhances a basic operating system by adding networking features.

Next, the software applications and version numbers will be identified and compared to the list of software applications and version numbers that have been tested to work with the process software. Those software applications that are missing or that do not match the correct version will be upgraded with the correct version numbers. Program instructions that pass parameters from the process software to the software applications will be checked to ensure the parameter lists match the parameter lists required by the process software. Conversely parameters passed by the software applications to the process software will be checked to ensure the parameters match the parameters required by the process software. The client and server operating systems including the network operating systems will be identified and compared to the list of operating systems, version numbers and network software that have been tested to work with the process software. Those operating systems, version numbers and network software that do not match the list of tested operating systems and version numbers will be upgraded on the clients and servers to the required level.

After ensuring that the software, where the process software is to be deployed, is at the correct version level that has been tested to work with the process software, the integration is completed by installing the process software on the clients and servers.

On Demand

The process software is shared, simultaneously serving multiple customers in a flexible, automated fashion. It is standardized, requiring little customization and it is scalable, providing capacity on demand in a pay-as-you-go model.

The process software can be stored on a shared file system accessible from one or more servers. The process software is executed via transactions that contain data and server processing requests that use CPU units on the accessed server. CPU units are units of time such as minutes, seconds, hours on the central processor of the server. Additionally the accessed server may make requests of other servers that require CPU units. CPU units describe an example that represents but one measurement of use. Other measurements of use include but are not limited to network bandwidth, memory utilization, storage utilization, packet transfers, complete transactions etc.

When multiple customers use the same process software application, their transactions are differentiated by the parameters included in the transactions that identify the unique customer and the type of service for that customer. All of the CPU units and other measurements of use that are used for the services for each customer are recorded. When the number of transactions to any one server reaches a number that begins to affect the performance of that server, other servers are accessed to increase the capacity and to share the workload. Likewise when other measurements of use such as network bandwidth, memory utilization, storage utilization, etc. approach a capacity so as to affect performance, additional network bandwidth, memory utilization, storage etc. are added to share the workload.

The measurements of use used for each service and customer are sent to a collecting server that sums the measurements of use for each customer for each service that was processed anywhere in the network of servers that provide the shared execution of the process software. The summed measurements of use units are periodically multiplied by unit costs and the resulting total process software application service costs are alternatively sent to the customer and/or indicated on a web site accessed by the customer which then remits payment to the service provider.

In another embodiment, the service provider requests payment directly from a customer account at a banking or financial institution.

In another embodiment, if the service provider is also a customer of the customer that uses the process software application, the payment owed to the service provider is reconciled to the payment owed by the service provider to minimize the transfer of payments.

Figure 6A:
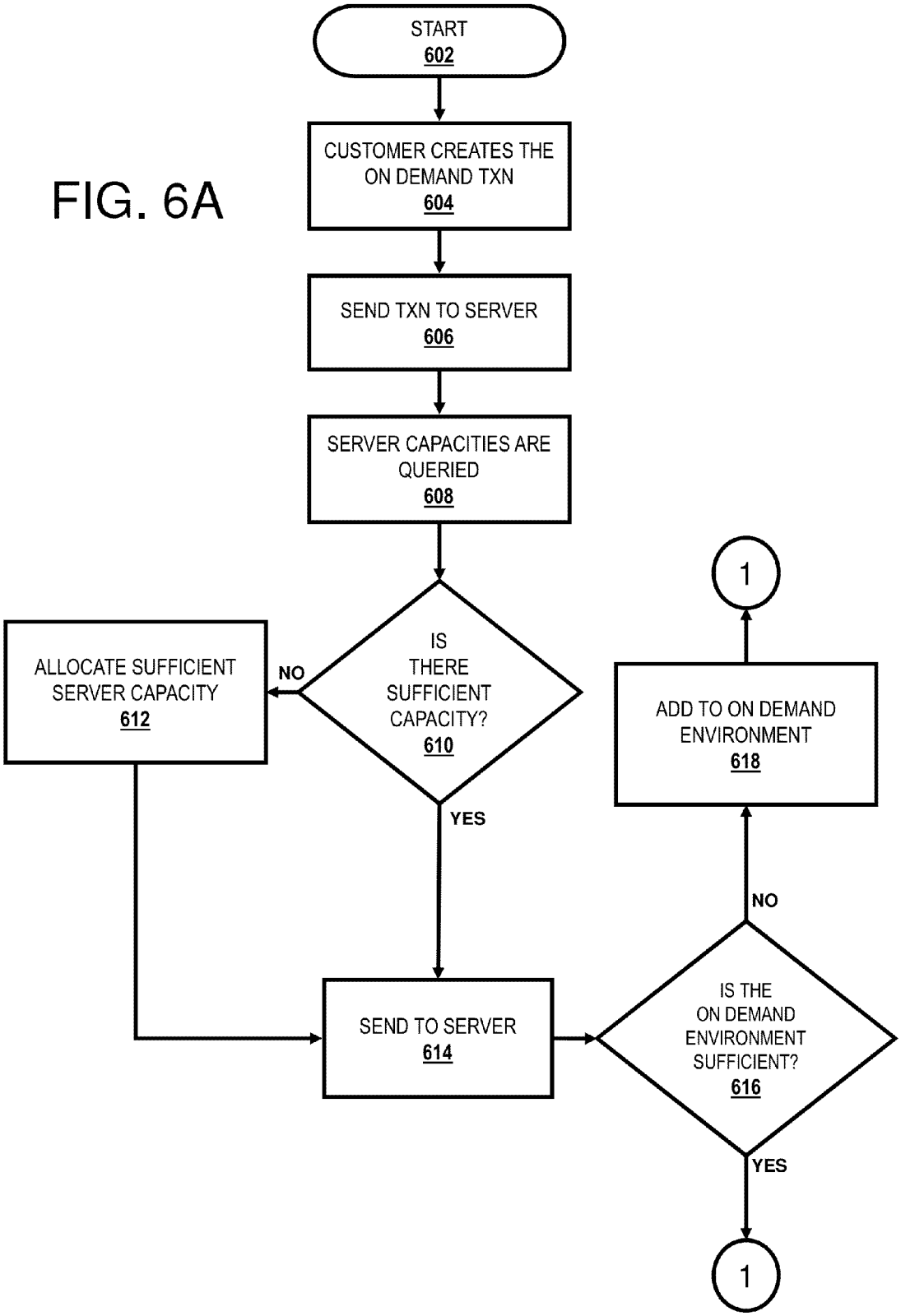
FIGS. 6A-B are flow-charts showing steps taken to execute the steps shown in FIGS. 1-3A using an on-demand service provider.
Figure 6B:
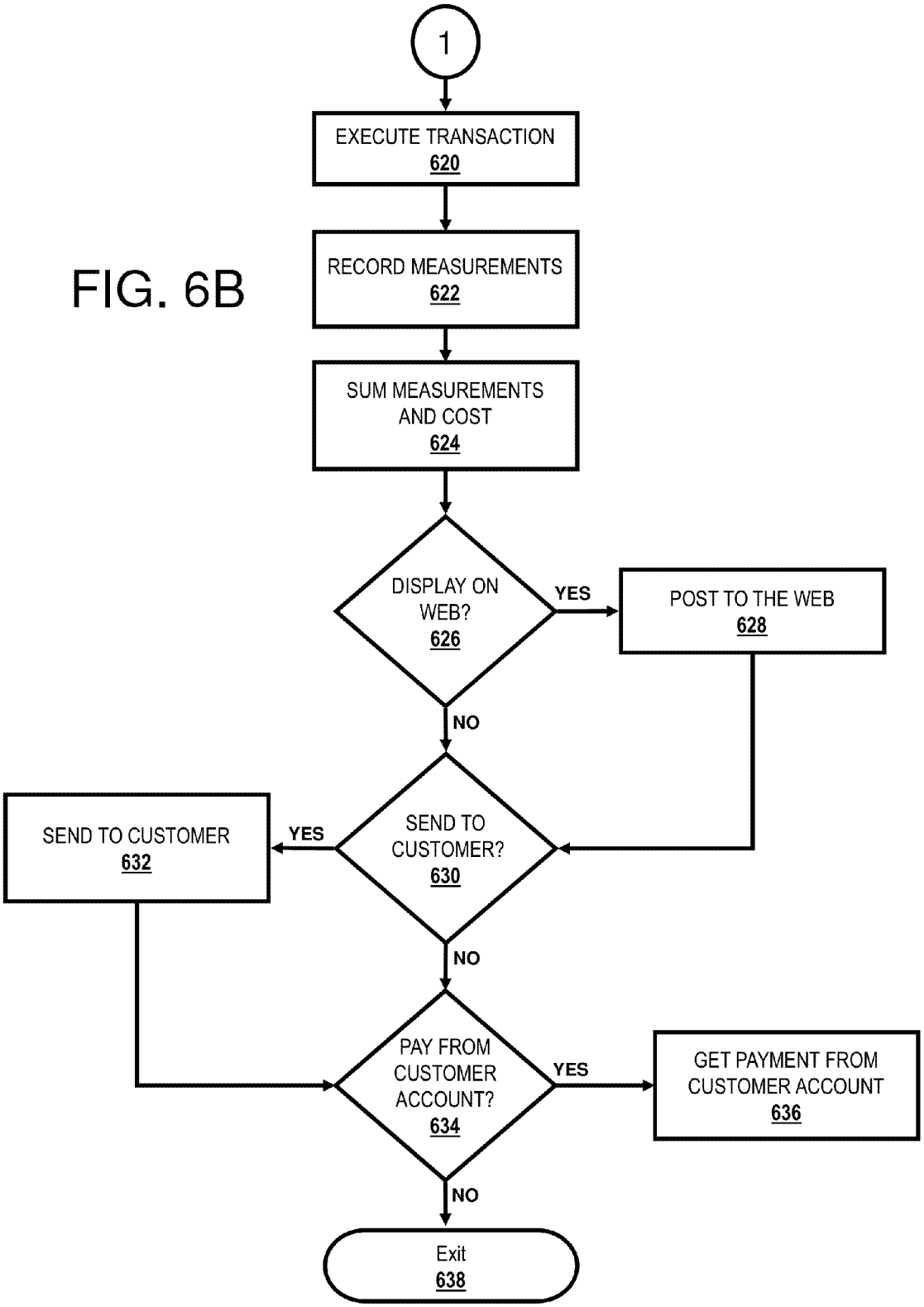

With reference now to FIGS. 6*a-b*, initiator block 602 begins the On Demand process. A transaction is created than contains the unique customer identification, the requested service type and any service parameters that further specify the type of service (block 604). The transaction is then sent to the main server (block 606). In an On Demand environment the main server can initially be the only server, then as capacity is consumed other servers are added to the On Demand environment.

The server central processing unit (CPU) capacities in the On Demand environment are queried (block 608). The CPU requirement of the transaction is estimated, then the server's available CPU capacity in the On Demand environment are compared to the transaction CPU requirement to see if there is sufficient CPU available capacity in any server to process the transaction (query block 610). If there is not sufficient server CPU available capacity, then additional server CPU capacity is allocated to process the transaction (block 612). If there was already sufficient available CPU capacity then the transaction is sent to a selected server (block 614).

Before executing the transaction, a check is made of the remaining On Demand environment to determine if the environment has sufficient available capacity for processing the transaction. This environment capacity consists of such things as but not limited to network bandwidth, processor memory, storage etc. (block 616). If there is not sufficient available capacity, then capacity will be added to the On Demand environment (block 618). Next the required software to process the transaction is accessed, loaded into memory, then the transaction is executed (block 620).

The usage measurements are recorded (block 622). The utilization measurements consist of the portions of those functions in the On Demand environment that are used to process the transaction. The usage of such functions as, but not limited to, network bandwidth, processor memory, storage and CPU cycles are what is recorded. The usage measurements are summed, multiplied by unit costs and then recorded as a charge to the requesting customer (block 624).

If the customer has requested that the On Demand costs be posted to a web site (query block 626), then they are posted (block 628). If the customer has requested that the On Demand costs be sent via e-mail to a customer address (query block 630), then these costs are sent to the customer (block 632). If the customer has requested that the On Demand costs be paid directly from a customer account (query block 634), then payment is received directly from the customer account (block 636). The On Demand process is then exited at terminator block 638.

The present invention thus overcomes may deficiencies found in the prior art. These deficiencies included, but were not limited to, (a) the sensor, even if "smart," does not create any leverage or act as anything other than an event tripper. All analysis is performed in a central service, and (b) there are many single points of failure including, but not limited to: if a sensor fails, if the communication channel to the sensor is down, or if the data mining programs are too slow or not searching for the right combinations to match the latest variation of activity. If these sensors are used in law enforcement or military situations, for example, the people or objects of interest are constantly changing behaviors to avoid detection. If used in medicine, small variations person to person can cause basic observations to be inadequate or even lead to wrong conclusions.

The present invention, however, overcomes these deficiencies in the prior art by providing a robust, local intelligent network that is capable of autonomously detecting and correcting problems in the field, without waiting for direction from a remote controller logic. As described herein, this invention reverses trend of using sensors that are fettered to a remote controller, and instead deploys pre-designed systems focused on the search for patterns in fields of different types of sensors based on pre-downloaded, likely combinations, of data points, or emergent information patterns. A point of departure for developing these search patterns to be downloaded into the sensor fields includes the patterns searched for after the data is all collected in today's approach. This is a sensor "grid" computing system, where the sensors themselves are smart, and interact with each other with a short-range communications protocol such as Zigbee™. This constant intercommunication between sensors provides each sensor with a chance to constantly "vote" as to whether they have a known pattern they need to report, and noted against several or more already downloaded patterns at once. There are many new patterns of search possible. Periodic reporting of a "no op" retains the network's confidence that it is still operating.

This new approach also creates a low power consumption profile for each sensor because they don't have to report "no op" all the time. Rather, each sensor in the field can take turns reporting for the whole field. This approach provides many network paths to get a report out when needed since each individual sensor, in a Zigbee™ type network, can be connected separately and report for all. This approach also provides for deterministic realtime data processing, such that constant addition, deletion, and changes of patterns can be analyzed. Furthermore, some of the field sensors can be out (disabled, off-line, powered down, "asleep") and the overall field can still be successful, since in numbers there is built-in redundancy, and with patterns, the system can provide a tentative "yes" vote (for reporting an anomaly) with some predetermined percentage (e.g. two-thirds) of the sensors reporting information that conformed to a pre-defined anomaly pattern.

Note that in one embodiment, management of the field sensors is handled by a Service Oriented Architecture (SOA) service, which provides for the management of these sensor types, such as building, storing, forward deploying, managing, and storing and analyzing the results from the data and emergent information generated by these sensors. Furthermore, an SOA service can build on the capabilities of a pattern-driven sensor network and Emergent Information Database Management System (EIDBMS) described in the above referenced related patent applications.

While the present invention has been particularly shown and described with reference to a preferred embodiment, it will be understood by those skilled in the art that various changes in form and detail may be made therein without departing from the spirit and scope of the invention. For example, while the present description has been directed to a preferred embodiment in which custom software applications are developed, the invention disclosed herein is equally applicable to the development and modification of application software. Furthermore, as used in the specification and the appended claims, the term "computer" or "system" or "computer system" or "computing device" includes any data processing system including, but not limited to, personal computers, servers, workstations, network computers, main frame computers, routers, switches, Personal Digital Assistants (PDA's), telephones, and any other system capable of processing, transmitting, receiving, capturing and/or storing data.

What is claimed is:

1. A method for utilizing emergent information from an array of sensors, the method comprising:

deploying an array of sensors to an array location, wherein the array of sensors comprises a plurality of different types of sensors;

programming each sensor in the array of sensors with at least one trigger rule, wherein the at least one trigger rule describes a local condition that must be met for the sensor to trigger an event signal to the other sensors in the array of sensors;

programming each sensor in the array of sensors with a relationship rule, wherein the relationship rule describes a hierarchy of communication control among sensors in the array of sensors;

providing each sensor of the array of sensors with controlling software that defines a set of search patterns that utilizes the plurality of different types of sensors within the array of sensors, wherein the set of search patterns is stored within each sensor in the array of sensors, and wherein each sensor in the array of sensors is capable of generating emergent information about the array location;

activating the array of sensors, wherein each sensor in the array of sensors monitors at least one condition of a plurality of conditions at the array location and transmits an event signal to the other sensors in the array of sensors in response to detecting an external stimulus that matches any of the set of search patterns stored within the sensor; and in response to the plurality of conditions at the array location causing a predetermined percentage of sensors, from the array of sensors, to each transmit an event signal which conforms to a known search pattern of the set of search patterns:

a first one or more sensors in the array of sensors generating emergent information about the array location, wherein the emergent information describes the plurality of conditions at the array location, and wherein the emergent information exists only when the predetermined percentage of sensors in the array of sensors each transmits an event signal; and the first one or more sensors sharing the generated emergent information with a remote server via a first one or more communication channels.

2. The method of claim 1, wherein the array location is on a water coastline, and wherein the array of sensors comprises a weather sensor, a thermal sensor, a video camera, a radar system, and an audio sensor.

3. The method of claim 1, wherein the array location is a well, and wherein the array of sensors comprises a pressure sensor and a heat sensor coupled to a downhole drill bit.

4. The method of claim 1, wherein the relationship rule defines how each sensor, in the array of sensors, communicates with other sensors in the array of sensors.

5. The method of claim 1, wherein the relationship rule defines which sensor, in the array of sensors, communicates with a remote controller for the array of sensors.

6. The method of claim 1, further comprising:

updating, from a remote controller, the at least one trigger rule and the relationship rule in each sensor in the array of sensors.

7. The method of claim 1, wherein each sensor in the array of sensors is programmed with a plurality of trigger rules, including the at least one trigger rule, wherein each trigger rule of the plurality of trigger rules is used in a generation of particular emergent information.

8. The method of claim 1, further comprising: recommencing monitoring the array location in response to the first one or more sensors sharing the generated emergent information with the remote server.

9. The method of claim 1, further comprising generating, from output data corresponding to the emergent information received from the array of sensors, reports, including (i) a description of a pattern within the output data from the plurality of sensors, (ii) supporting data that supports the pattern within the output data from the plurality of sensors, (iii) emergent results including next-level information derived from the output data from the plurality of sensors, and (iv) deterministic real time information that comprises diagnostic data regarding each sensor within the array of sensors and each sensor's lines of communication with other sensors within the array of sensors and the remote server.

10. The method of claim 1, further comprising providing a low power consumption profile for each sensor within the array of sensors, which enables each respective sensor to operate in a low power mode during which the sensor does not report no operation (no op) events.

11. The method of claim 10, wherein:

the array of sensors is communicatively connected to the remote server via the first one or more communication channels of a plurality of communication channels; and each individual sensor of the array of sensors is separately connected to the remote server via at least one communication channel.

12. The method of claim 11, wherein the plurality of communication channels comprises a Zigbee™-type network.

13. The method of claim 1, further comprising:

providing the set of search patterns as a download to the array of sensors; and analyzing received output data corresponding to the emergent information generated by each sensor of the array of sensors and matching, in real time, the emergent information generated by each sensor against the set of search patterns.

14. The method of claim 1, wherein: the relationship rules are utilized if a consolidated event signal, based on a predetermined number of sensors in the array of sensors each transmitting an event signal, is to be transmitted via a gateway and a transmit network to a remote controller.

15. The method of claim 1, wherein the emergent information is generated by consolidating a plurality of event signals from all sensors in the array of sensors.

16. The method of claim 1, further comprising, in response to the local condition for the at least one trigger rule being met, sending at least one event signal to a central controlling and emergent information pattern generating server, wherein the central controlling and emergent information pattern generating server displays at least one of: details associated with the at least one event signal and a consolidation of one or more event signals as emergent information.

17. The method of claim 1, wherein each sensor in the array of sensors comprises a plurality of trigger rules, including the at least one trigger rule.

18. The method of claim 1, further comprising, in response to generating the emergent information, performing a local response which addresses and corrects anomalies associated with the plurality of conditions at the array location, wherein the local response includes turning on a particular sensor in the array of sensors.

19. The method of claim 1, further comprising:

in response to the first one or more sensors sharing the generated emergent information with the remote server via the first one or more communication channels, a second one or more sensors of the plurality of sensors sharing the generated emergent information with the remote server via a second one or more communication channels.

20. A method for utilizing emergent information from an array of sensors, the method comprising:

deploying an array of sensors to an array location, wherein the array of sensors comprises a plurality of different types of sensors, wherein the array location is on a water coastline, and wherein the array of sensors comprises a weather sensor, a thermal sensor, a video camera, a radar system, and an audio sensor;

programming each sensor in the array of sensors with a plurality of trigger rules, wherein a trigger rule describes a local condition that must be met for the sensor to trigger an event signal to the other sensors in the array of sensors, and wherein each trigger rule of the plurality of trigger rules is used in a generation of particular emergent information;

programming each sensor in the array of sensors with a relationship rule, wherein the relationship rule describes a hierarchy of communication control among sensors in the array of sensors, and wherein the relationship rule defines how each sensor, in the array of sensors, communicates with other sensors in the array of sensors, and wherein the relationship rule defines which sensor, in the array of sensors, communicates with a remote controller for the array of sensors;

providing each sensor of the array of sensors with controlling software that defines a set of search patterns that utilizes the plurality of different types of sensors within the sensors, wherein the set of search patterns is stored within each sensor in the array of sensors, and wherein each sensor in the array of sensors is capable of generating emergent information about the array location;

activating the array of sensors, wherein each sensor in the array of sensors monitors at least one condition of a plurality of conditions at the array location and transmits an event signal to the other sensors in the array of sensors in response to detecting an external stimulus that matches any of the set of search patterns stored within the sensor;

in response to the plurality of conditions at the array location causing a predetermined percentage of sensors, from the array of sensors, to each transmit an event signal which conforms to a known search pattern of the set of search patterns:

a first one or more sensors of the array of sensors consolidating event signals from all sensors in the array of sensors and generating emergent information about the array location, wherein the emergent information describes the plurality of conditions at the array location, and wherein the emergent information exists only when the predetermined percentage of sensors in the array of sensors each transmits an event signal;

the first one or more sensors sharing the generated emergent information with a remote server via a first one or more communication channels; and in response to the first one or more sensors sharing the generated emergent information with a remote server via the first one or more communication channels, a second one or more sensors of the plurality of sensors sharing the generated emergent information with the remote server via a second one or more communication channels; and updating, via the remote controller, at least one trigger rule of the plurality of trigger rules and the relationship rule in each sensor in the array of sensors.

* * * * *